US005452479A

United States Patent [19]

Mostert

[11] Patent Number: 5,452,479

[45] Date of Patent: Sep. 26, 1995

[54] CAP WITH DISPLAY POUCH

[76] Inventor: Charles D. Mostert, 303 Decker St., Santa Rosa, Calif. 95401

[21] Appl. No.: 210,430

[22] Filed: Mar. 21, 1994

[51] Int. Cl.[6] ..... A42B 1/24

[52] U.S. Cl. ..... 2/195.1; 2/209.13; 40/329

[58] Field of Search ..... 2/171, 175.1, 181, 2/181.4, 195.1, 209.11, 209.12, 209.13, 422, 909, 918, 247; 40/329, 586, 312, 662

[56] References Cited

U.S. PATENT DOCUMENTS 2,803,829 8/1957 Tscharner ..... 2/181
4,386,437 6/1983 Fosher ..... 2/209.13
5,233,703 8/1993 Galka ..... 2/209.13
5,276,985 1/1994 Halloran ..... 2/209.13

*Primary Examiner*—Clifford D. Crowder
*Assistant Examiner*—Diana L. Biefeld
*Attorney, Agent, or Firm*—Michael I. Kroll

[57] ABSTRACT

A cap with display pouch is provided, which consists of a member for covering a head of a person. A structure is for holding a card-like article. A component is for attaching the holding structure to the head covering member.

6 Claims, 2 Drawing Sheets

CAP WITH DISPLAY POUCH

BACKGROUND OF THE INVENTION

Field of the Invention

The instant invention relates generally to head coverings and more specifically it relates to a cap with display pouch.

Description of the Prior Art

Numerous head coverings have been provided in prior art. For example, U.S. Pat. Nos. Des. 68,685 to Weinrott et al.; 2,803,829 to Tscharner; 5,233,703 to Galka and 5,276,895 to Halloran all are illustrative of such prior art. While these units may be suitable for the particular purpose to which they address, they would not be as suitable for the purposes of the present invention as heretofore described.

The ornamental design for a cap is provided.

Figure 1:
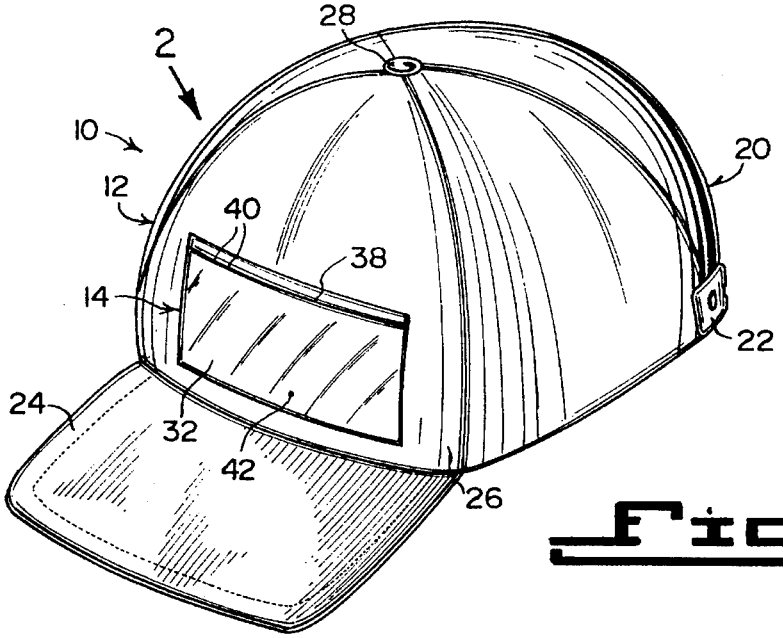
FIG. 1 shows a front elevation of the new cap.

In a cap, the combination which comprises an upwardly bowed layer of material including a plurality of triangular-shaped segments providing a hat crown, said material is extended downwardly at the periphery of the crown providing a vertically disposed outer wall of an endless band. The material is extended inwardly and upwardly from the lower edge of the outer wall providing an inner wall and the upper edge of the inner wall being stitched to the upper portion of the outer wall providing an open space between the walls. The outer wall has spaced opening providing windows therein. Panels of stiffening material are positioned between the walls and against the inner wall providing a backing. Photographs are between the walls and positioned to be displayed through the windows. Transparent panels are also positioned between the inner and outer walls and cover the photographs. The outer wall has vertically disposed slots therein through which the photographs may be removed from and replaced in pockets in the band and positioned in registering relation with the windows therein.

A head covering, such as a cap of the type having a visor and head-encircling portion is provided, with an identification pocket formed in the visor by upper and lower panels disposed in closely spaced parallel relation to one another. The lower panel is separable from the upper panel, to form an entrance for lasertion of an identification card into the pocket formed between the panels. In one form, the lower panel is of a smaller size than the upper panel and attached in centered relation to the upper panel with a separable edge portion facing inwardly toward the head-encircling portion of the cap. In an alternate form the lower panel is coextensive with the upper panel and has an inner edge portion releasably secured to the inner edge portion of the upper panel to form an entrance for insertion of identification cards therein.

A detachable plaque for a cap having a visor and an adjoining crown portion is provided. The plaque generally comprises a flexible plastic sheet-like member having a live hinge or crease which defines a boundary between an upper portion of the sheet-like member and the lower portion of the sheet-like member. A first coupling or mating device is incorporated on the upper portion of the sheet-like member for detachably engaging a mating member on the crown portion of the cap. A second coupling or mating device is incorporated on the lower portion of the sheet-like member for detachably engaging a second mating member on the visor of the cap. The first and second coupling devices may be snaps and/or snap receivers, sockets and/or domed plugs, Velcro hook and/or loop fasteners, etc. In accord with one embodiment of the invention, the flexible plastic sheet has an aperture in at least the upper portion for receiving a piece of cardboard or paper on which a message or information is printed.

SUMMARY OF THE INVENTION

A primary object of the present invention is to provide a cap with display pouch that will overcome the shortcomings of the prior art devices.

Another object is to provide a cap with display pouch that is a head covering and a transparent pocket, which is attached to a front outer surface of the head covering to retain and show a card-like article therefrom.

An additional object is to provide a cap with display pouch in which the transparent pocket contains a resealable slot, so as to allow the insertion and removal of the card-like article through the slot.

A further object is to provide a cap with display pouch that is simple and easy to use.

A still further object is to provide a cap with display pouch that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a front right perspective view of the instant invention.

Figure 2:
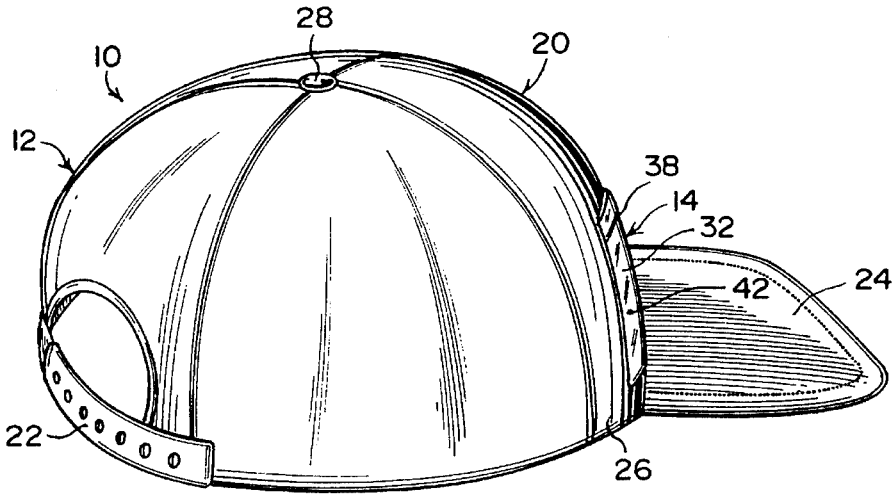
FIG. 2 shows a side elevation thereof.

FIG. 2 is a rear left perspective view taken in the direction of arrow 2 in FIG. 1.

Figure 3:
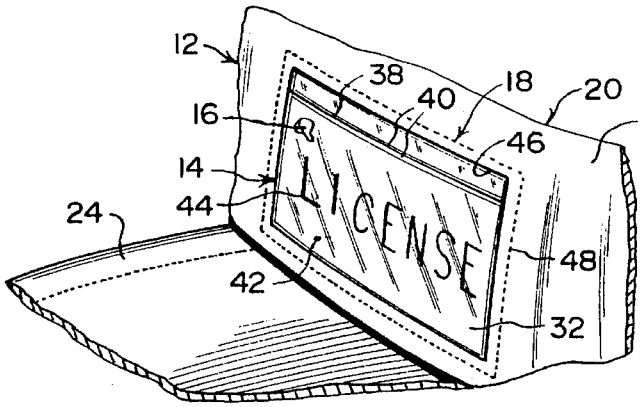

FIG. 3 is an enlarged front right perspective view of a portion thereof, showing the transparent pocket member holding a card-like article therein.

Figure 4:
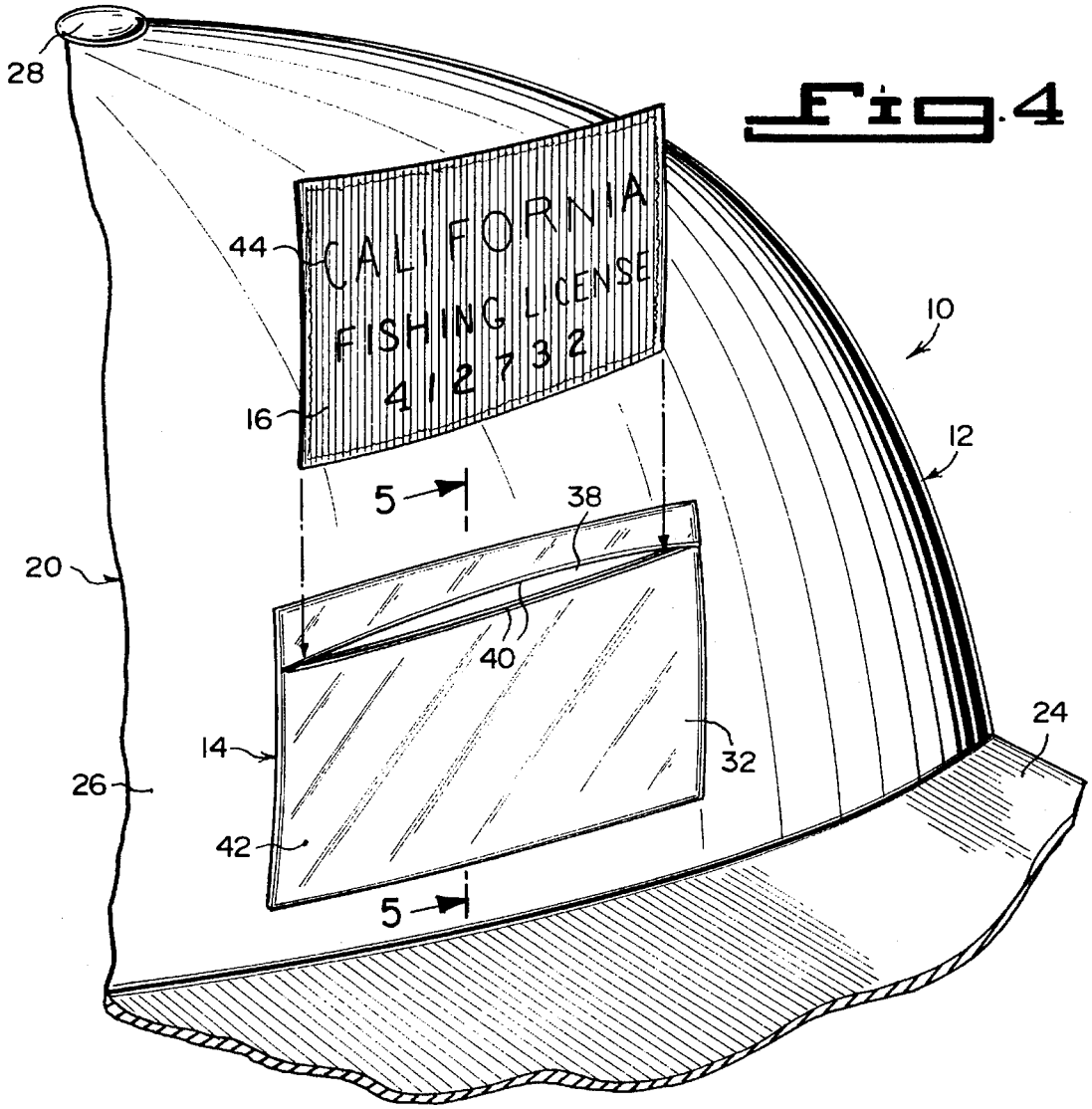

FIG. 4 is a still further enlarged front left perspective view of a portion thereof, showing the card-like article ready to be inserted within the transparent pocket member.

Figure 5:
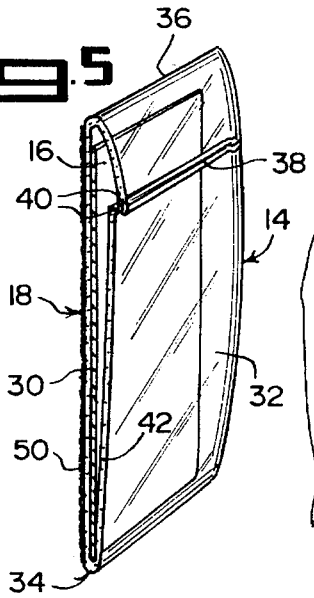

FIG. 5 is a cross sectional view taken along line 5—5 in FIG. 4 of just the transparent pocket member with the card-like article therein.

Figure 6:
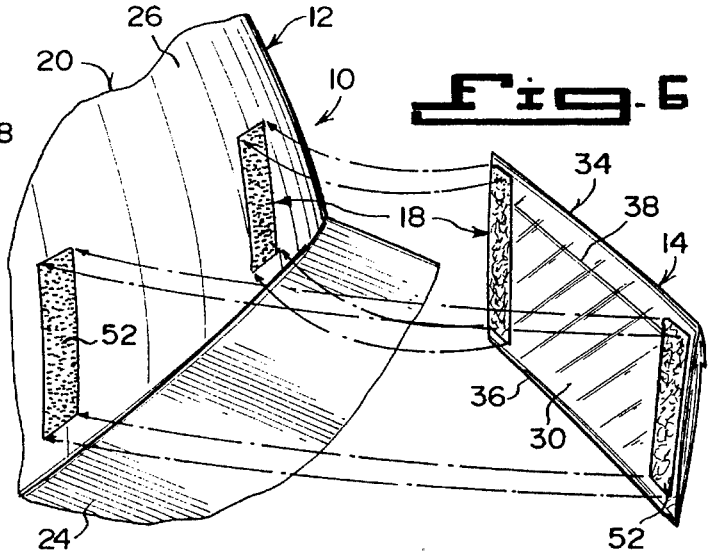

FIG. 6 is a front left perspective view of a portion thereof, showing the transparent pocket member exploded therefrom and ready to be installed with mating hook and loop pile fabric strips.

DETAILED DESCRIPTION OF THE PREFERRED EMBODIMENTS

Turning now descriptively to the drawings, in which similar reference characters denote similar elements throughout the several views, FIGS. 1 through 6 illustrate a cap with display pouch 10, which consists of a member 12 for covering a head of a person. A structure 14 is for holding a card-like article 16. A component 18 is for attaching the holding structure 14 to the head covering member 12.

The head covering member 12 includes a crown 20 with a flexible adjustable band 22 at a lower edge of the crown 20. The band 22 will allow the crown 20 to snugly fit onto the head of the person. A visor 24 extends outwardly from the lower edge of the crown 20.

The crown 20 contains a plurality of flexible fabric gore portions 26 sewn together to form the crown 20. A button 28 is affixed onto an apex of the crown 20.

The holding structure 14 consists of a rear panel 30, a front panel 32 and an element 34 for connecting the outer peripheral edges of the rear panel 30 to the front panel 32. The connecting element 34 is a heat seal 36, applied to the outer peripheral edges between the rear panel 30 and the front panel 32.

The front panel 32 has a slot 38 thereacross adjacent to and parallel with a top edge, so as to form a hollow pocket between the rear panel 30 and the front panel 32, to allow the insertion and removal of the card-like article 16 through the slot 38. The slot 38 includes a resealable closure 40, so that the slot 38 can be sealed after the card-like article 16 is inserted therein. The front panel 32 is fabricated out of a transparent material 42, so that any indicia 44 on the card-like article 16 can be seen through the front panel 32.

The attaching component 18, as shown in FIG. 3, consists of the front gore portion 26 of the crown 20 adjacent the visor 24 having a window opening 46 therethrough, slightly smaller than the outer peripheral edges of the rear panel 30 and the front panel 32, with the heat seal 36. The holding structure 14 will fit behind the window opening 46. Threads 48 are for sewing the outer peripheral edges of the rear panel 30 and the front panel 32 about the edges of the window opening 46. The holding structure 14 will be secured to a back surface of the front gore portion 26.

The attaching component 18 in FIG. 5, contains adhesive material 50 applied between the rear panel 30 and the front gore portion 26 of the crown 20, so that the rear panel 30 will stick thereto. A protective peelable cover sheet (not shown) can be placed onto the adhesive material 50, when the holding structure 14 is ready to be applied. The cover sheet is simply removed to expose the adhesive material 50. The attaching component 18 in FIG. 6, includes a plurality of mating hook and loop pile fastener material strips 52, applied between the rear panel 30 and the front gore portion 26 of the crown 20, so that the rear panel 30 will stick thereto in a removable manner.

Different types of card-like articles 16 can be placed within the holding structure 14, such as a drivers license, a fishing license, a hunting license, an identification tag, a photograph and similar items. The crown 20 and band 22 can be fabricated out of a cloth, or soft plastic material. The visor 24 can also be fabricated out of the cloth or soft plastic material, with a cardboard stiffness therein to provide a sunshade over the eyes of the person.

OPERATION OF THE INVENTION

To use the cap with display pouch 10, shown in FIG. 3, the following steps should be taken:

1. Sew the threads 48 about the edges of the window opening 46 in the front gore portion 26 of the crown 20, to secure the front panel 32 and rear panel 30 thereto.

2. Open the resealable closure 40 on the slot 38 in the front panel 32.

3 Insert the card-like article 16 within the holding structure, so that the indicia can be seen through the transparent material 42 of the front panel 32.

4. Close the resealable closure 40 on the slot 38 in the front panel 32, to protect the card-like article 16 therein.

To use the cap with display pouch 10, shown in FIG. 5, the following steps should be taken:

1. Remove the protective peelable cover sheet from the adhesive material 50.

2. Place the adhesive material 50 on the rear panel 30 against the front gore portion 26 of the crown 20, to secure the rear panel 30 thereto.

3. Open the resealable closure 40 on the slot 38 in the front panel 32.

4. Insert the card-like article 16 within the holding structure, so that the indicia can be seen through the transparent material 42 of the front panel 32.

5. Close the resealable closure 40 on the slot 38 in the front panel 32, to protect the card-like article 16 therein.

To use the cap with display pouch 10, shown in FIG. 6, the following steps should be taken:

1. Press the mating hook and loop pile fastener material strips 52 together, so that the rear panel 30 will stick to the front gore portion 26 of the crown in a removable manner.

2. Open the resealable closure 40 on the slot 38 in the front panel 32.

3. Insert the card-like article 16 within the holding structure, so that the indicia can be seen through the transparent material 42 of the front panel 32.

4. Close the resealable closure 40 on the slot 38 in the front panel 32, to protect the card-like article 16 therein.

LIST OF REFERENCE NUMBERS

| | |
|---|---|
| 10 | cap with display pouch |
| 12 | head covering member |
| 14 | holding structure |
| 16 | card-like article |
| 18 | attaching component |
| 20 | crown |
| 22 | flexible adjustable band |
| 24 | visor |
| 26 | gore portion |
| 28 | button |
| 30 | rear panel |
| 32 | front panel |
| 34 | connecting element |
| 36 | heat seal for 34 |
| 38 | slot in 32 |
| 40 | resealable closure on 38 |
| 42 | transparent material for 32 |
| 44 | indicia on 16 |
| 46 | window opening in 26 |
| 48 | threads |
| 50 | adhesive material |
| 52 | mating hook and loop pile fastener material strips |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A cap with display pouch which comprises:

a) means for covering a head of a person, said head covering means including a crown, a flexible adjustable band at a lower edge of said crown, so that said band will allow said crown to snugly fit onto the head of the person, and a visor extending outwardly from the lower edge of said crown, said crown including a plurality of flexible fabric gore portions sewn together to form said crown, and a button affixed onto an apex of said crown;

b) means for holding a card-like article, said holding means including a rear panel, a front panel, and means for connecting the outer peripheral edges of said rear panel to said front panel, said connecting means being a heat seal applied to the outer peripheral edges between said rear panel and said front panel, said front panel having a slot thereacross adjacent to and parallel with a top edge, so as to form a hollow pocket between said rear panel and said front panel, to allow the insertion and removal of the card-like article through said slot; and c) means for attaching said holding means to said head covering means.

2. A cap with display pouch as recited in claim 1, wherein said slot includes a resealable closure, so that said slot can be sealed after the card-like article is inserted therein.

3. A cap with display pouch as recited in claim 2, wherein said front panel is fabricated out of a transparent material, so that any indicia on the card-like article can be seen through said front panel.

4. A cap with display pouch as recited in claim 3, wherein said attaching means includes:

a) said front gore portion of said crown adjacent said visor having a window opening therethrough, slightly smaller than the outer peripheral edges of said rear panel and said front panel with said heat seal, whereby said holding means will fit behind said window opening; and b) threads for sewing the outer peripheral edges of said rear panel and said front panel about the edges of said window opening, so that said holding means will be secured to a back surface of said front gore portion.

5. A cap with display pouch as recited in claim 3, wherein said attaching means includes adhesive material applied between said rear panel and said front gore portion of said crown, so that said rear panel will stick thereto.

6. A cap with display pouch as recited in claim 3, wherein said attaching means includes a plurality of mating hook and loop pile fastener material strips applied between said rear panel and aid front gore portion of said crown, so that said rear panel will stick thereto in a removable manner.

* * * * *